United States Patent [19]

Lowther

[11] 4,009,416

[45] Feb. 22, 1977

[54] METHOD FOR OPERATING A GASEOUS DISCHARGE LAMP WITH IMPROVED EFFICIENCY

[75] Inventor: Frank Eugene Lowther, Severna Park, Md.

[73] Assignee: W. R. Grace & Co., New York, N.Y.

[22] Filed: July 10, 1975

[21] Appl. No.: 594,790

[52] U.S. Cl. ..... 315/176; 315/167; 315/172; 315/219; 315/246; 315/260; 315/334; 315/340; 315/DIG. 5

[51] Int. Cl.[2] ..... H05B 41/16; H05B 41/30

[58] Field of Search ..... 315/160, 167, 170, 171, 315/172, 176, 219, 246, 260, 291, 326, 334, 340, DIG. 5, DIG. 7, 224

[56] References Cited

UNITED STATES PATENTS

| | | | |
|---|---|---|---|
| 3,560,795 | 2/1971 | Pollack et al. | 315/224 X |
| 3,624,447 | 11/1971 | Young et al. | 315/176 X |
| 3,876,907 | 4/1975 | Widmayer | 315/DIG. 5 |

*Primary Examiner*—Eugene La Roche
*Attorney, Agent, or Firm*—Arthur P. Savage

[57] ABSTRACT

A method for improving the light producing efficiency of gas filled electrical discharge tubes wherein a high voltage narrow pulsed ionizing potential is applied across the electrodes of the tube along with a relatively low bias potential.

8 Claims, 3 Drawing Figures

METHOD FOR OPERATING A GASEOUS DISCHARGE LAMP WITH IMPROVED EFFICIENCY

The present invention relates to an improved light source, and more specifically to a method for increasing the amount of light which is produced from a gas filled electrical discharge tube from application of a given amount of electrical energy.

Gas filled tubes, such as fluorescence tubes, flash tubes, etc., which generally comprise a pair of spaced electrodes contained in a transparent or fluorescent coated gas filled envelope are generally considered to be poor converters of electrical energy to light. When typical tubes are filled with minor pressures of gas such as argon, krypton and neon and operated at their sparking (ionization) potential using conventional 60 cycle AC current, it is generally found that up to 90 percent of the applied electrical energy is dissipated as waste heat.

It has been suggested that the light conversion efficiency of gas filled tubes may be increased by application of high frequency, that is, 400 to 20,000 Hz AC power. Thus far, however, increases in efficiency from gas filled tubes using high frequency power has amounted to only about 10 percent.

It is therefore an object of the present invention to provide a more efficient light source.

It is a further object to provide a means by which the conversion of electrical energy to light may be increased.

It is another object to provide a method by which gas electrical discharge tubes may be operated at their ionization potential to produce visible light in a more efficient manner.

These and still further objects of the present invention will become readily apparent to one skilled in the art from the following detailed description and drawings wherein.

Broadly, my invention contemplates a method for operating a gas filled electrical discharge lighting tube wherein a high voltage potential having a pulse wave form in combination with a low bias potential is applied across the electrodes of the tube.

More specifically, I have found that the light conversion efficiency of a gas filled electrical discharge tube may be substantially increased by using pulsed electrical energy of a waveform in which the pulses have a voltage in excess of the sparking potential and a duration less than the gas ion transit time between the electrodes of the tube but greater than the electron transit time; and in addition applying a low voltage bias potential between pulses.

Figure 1:
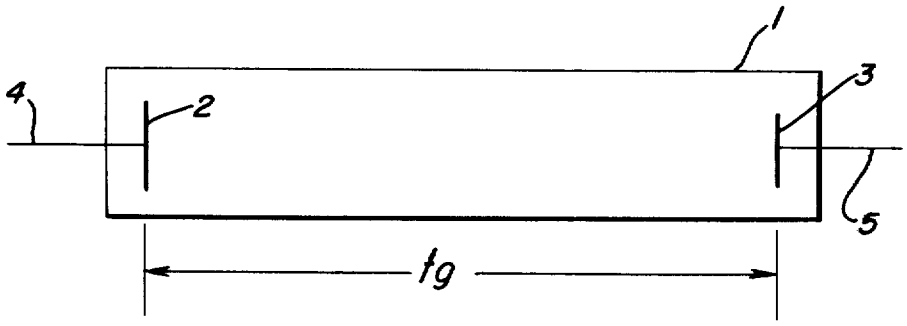
FIG. 1 is a plain view of a typical gas filled electrical discharge tube used in the practice of the present invention.

A more clear understanding of the present invention may be obtained by reference to FIG. 1 of the drawing which discloses a typical gas filled electrical discharge tube which comprises a transparent glass envelope 1, in which discharge electrodes 2 and 3 are hermetically sealed. The electrode 2 is connected to a source of potential by conductor 4 whereas the electrode 3 is supplied by conductor 5. At the point where the conductors 4 and 5 enter the envelope 1, appropriate means are provided for sealing the interior of the envelope 1 from the atmosphere. Typically, the envelope 1 is prepared by evacuating the interior thereof and then adding a small quantity of gas, such as argon and krypton in amounts wherein the pressure of the added gas within the envelope ranges from about $10^{-6}$ to $10^{-1}$ atmospheres. As shown in FIG. 1, the distance between the opposing electrodes 2 and 3 is indicated as $t_g$ and typically this distance may range from about 1 to 10,000 cm.

Figure 2:
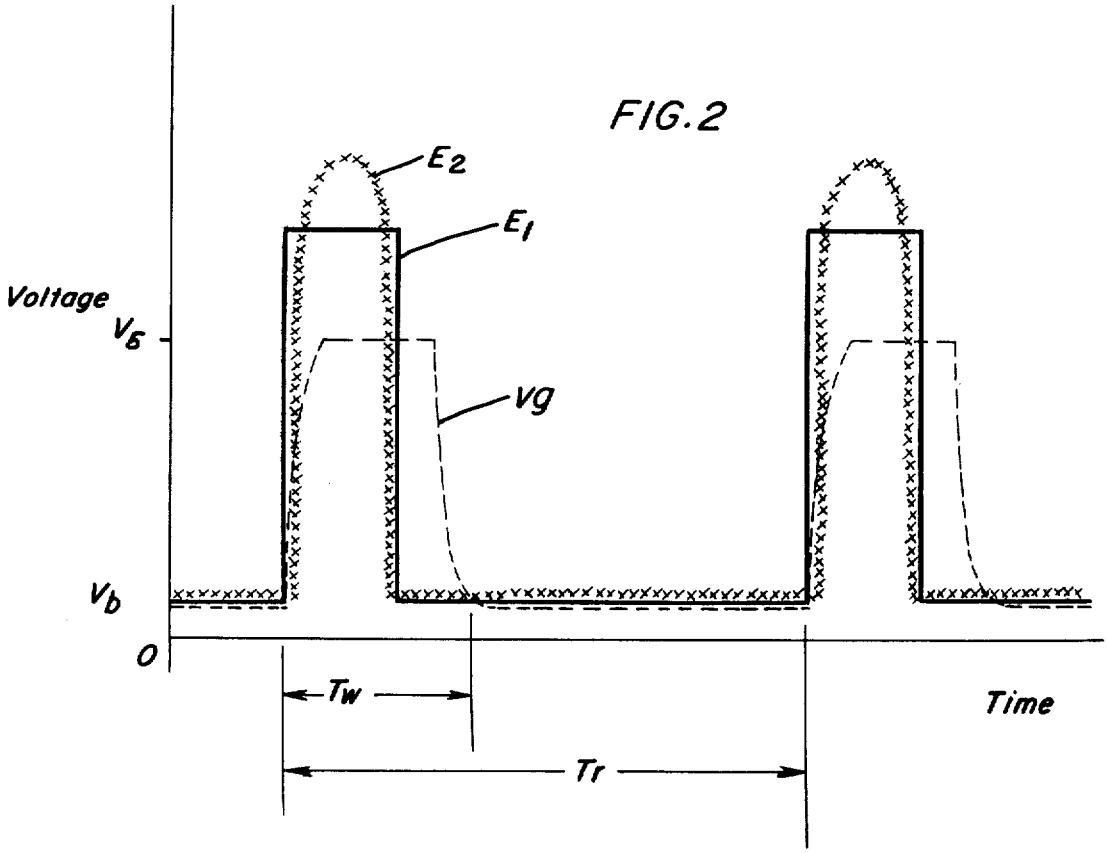
FIG. 2 is a graph in which voltage is plotted on the vertical axis and time on the horizontal axis and which portrays a preferred form of the electrical energy used in the present invention.

FIG. 2 discloses a preferred waveform of the electrical energy which is dissipated between the electrodes 2 and 3 of the tube shown in FIG. 1. In FIG. 2 it is noted that three curves ae set forth which indicate the potential appearing at various points in the flash tube circuit during typical cyclic operation of the circuit. Curve E-1, which is plotted as a solid line, represents a narrow square wave electrical pulse which is produced by a high voltage narrow pulse power supply which typically may employ a gas filled tube switching device. The curve E-2, which is represented by a series of *x*'s, indicates the potential which is applied to the flash tube of FIG. 1 subsequent to passing through a suitable inductance. Curve Vg, which is indicated as a dashed line, represents the potential which appears across the electrode gap $t_g$ indicated in FIG. 1. As shown in FIG. 2, the applied pulse which appears across the gap $t_g$ is indicated as $T_w$. The pulse repetition period is indicated on FIG. 2 as $T_r$. On the horizontal axis, two points are indicated, $V_s$, which represents the sparking or ionization potential of the voltage which appears across the electrodes of the tube, and $V_b$ which is a bias potential applied between the electrodes of the tube between pulses.

Figure 3:
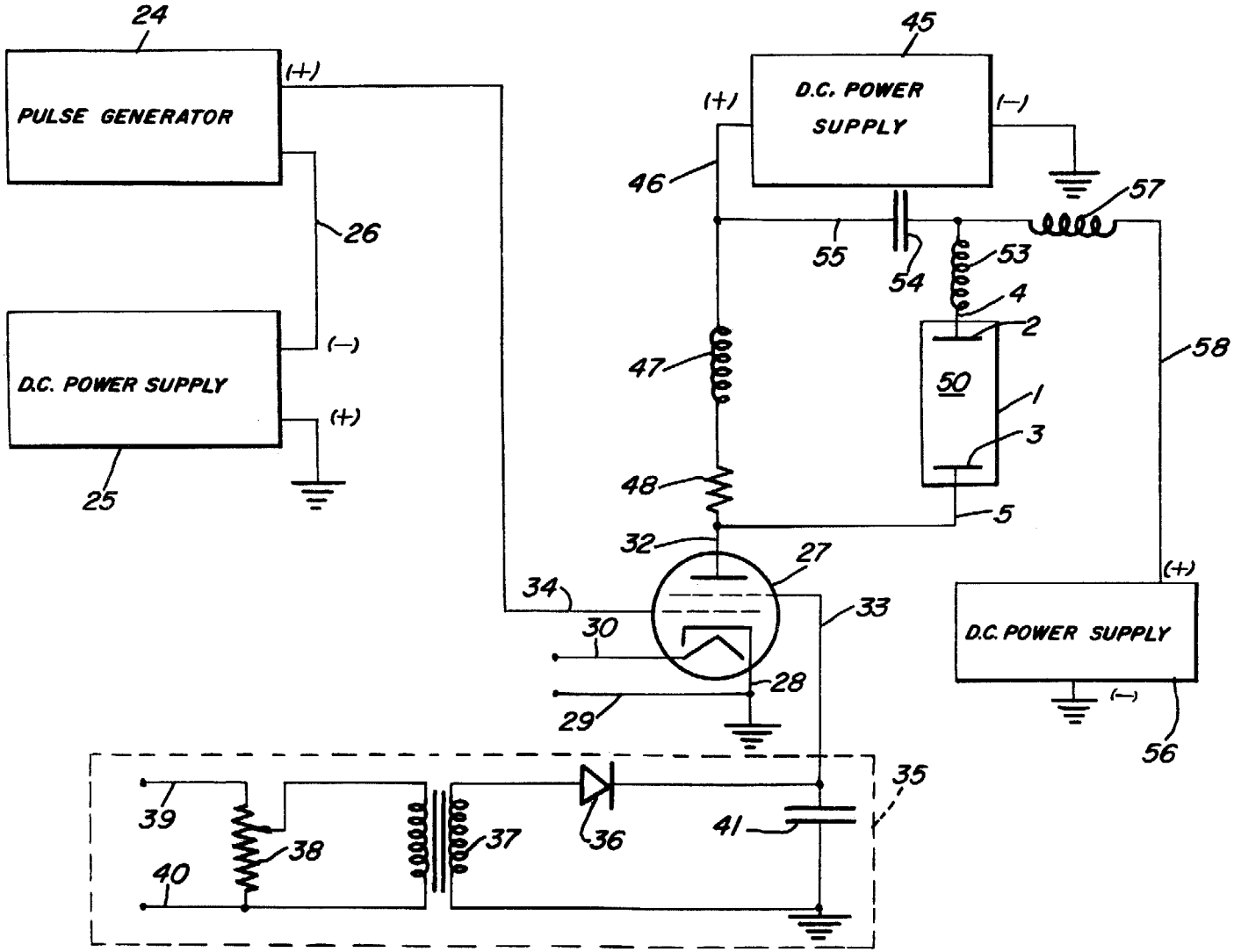
FIG. 3 is a power supply circuit which may be used to provide the wave form set forth in FIG. 2.

Reference to FIG. 3 reveals a typical narrow pulse power supply circuit which may be used to produce the preferred potential or power waveform set forth in FIG. 2. The circuit in FIG. 3 comprises a pulse generator 24 which is then connected to a DC power source for the pulse generator by means of connecter 26. The positive side of the DC power supply 25 is connected to ground. The circuit also includes a gas filled switch tube 27 which comprises a tetrode having a cathode lead 28 and cathode heater leads 29 and 30 which are attached to a suitable source of power, now shown herein. The tube 27 also is provided with a plate lead 32 and grid leads 33 and 34. It is noted that the control grid lead 34 is connected to the pulse generator 24, whereas the secondary grid lead 33 is connected to a bias potential source, generally indicated as 35. Bias potential source 35 comprises a diode 36 which is connected in series with the secondary of a transformer 37. The primary winding of the transformer 37 is in series with a variable resistance 37 which in turn is connected across a source of AC power through connectors 39 and 40. The diode 36 is also connected in series with a capacitor 41. The output of the bias potential power supply 35 is connected to the secondary grid lead 33 and to ground.

The plate lead 32 is connected to a DC power supply 45 through a lead 46 which is connected in series with inductance 47 and resistance 48. The negative side of the power supply 45 is grounded. The circuit also includes a gas filled flash tube 50, one electrode of which is connected to gate lead 32, the other electrode of which is connected to a lead 52, which in turn is connected to an inductance 53. The inductance 53 is connected to the positive output side of the power supply 45 through a capacitor 54 and lead 55. The inductance 53 is also connected to a DC power supply 56 through an inductance 57 and lead 58.

In operation, the leads 4 and 5 of the gas filled flash tube of FIG. 1 are connected to the power supply shown in FIG. 3. To determine the waveform necessary to obtain the proper operation of the flash tube, generally 50, the sparking potential and discharge gap dimension are determined by measurement. As indicated above, the circuit of FIG. 3 is operated to provide an electrical power waveform such as shown in FIG. 2. To do this, the specifications are set for $T_w$, $T_r$, $V_s$ and $V_b$. $V_s$, which is the sparking or ionization potential of the tube is readily determined by measurement or may be calculated as shown hereafter. The specification for the required pulse width $T_w$ requires that $T_w$ be less than the gas ion transit time, $T_{ion}$, but greater than the electron transit time $T_e$. To determine $T_{ion}$ the methods and calculations set forth by J. D. Cobine in "Gaseous Conductors", Dover Publications, N.Y. 1958 may be conveniently used. The value of $T_e$ is calculated from $T_{ion}$ by comparing the masses of the electron with the mass of the gas ion in question, that is:

$$T_e = \frac{\text{Tion}}{\sqrt{1840 \times \text{Mass of ion}}}$$

The pulse repetition period (which is the reciprocal of the frequency), $T_r$, is selected to give the desired degree of luminous intensity and an acceptable level of flicker for the application intended. The intensity (lumens) varies directly with the frequency, that is, number of pulses per second. Furthermore, it is noted that if the frequency drops below a certain level, not only will the intensity drop but the light will flicker. The minimum frequency for normal lumination purposes is about 60 cycles/second.

The gas ion transit time is determined as set forth by Cobine as follows:

$$T_{ion} = \left(\frac{1}{kp}\right) \frac{tg^2\, p}{40\, ptg + 1350}$$

$p$ = gas pressure (mmHg)
$tg$ = electrode — electrode separation (cr)
$kp$ = constant for any gas

| Gas | kp |
|---|---|
| He | 3868 |
| $N_2$ | 962 |
| $O_2$ | 996 |

In order to obtain an increase in the overall light producing efficiency of the discharge tube, it is necessary to apply a bias potential $V_b$ which is sufficient between electrical pulses to remove a substantial quantity of the charged gas molecules, that is, ions, which are created in the gap $t_g$. To calculate the desired value for $V_b$ the following calculations are made:

$$V_b = \frac{T_w}{T_r} \times V_s \qquad V_s = 40\, ptg + 1350$$

| | | |
|---|---|---|
| $V_b$ | = Bias Potential (volts) | p = gas pressure (mmHg) |
| $T_w$ | = Pulse width (usec) | tg = electrode separation (cm) |
| $T_r$ | = Interpulse period (usec) | |
| $V_{op}$ | = Operating voltage | |

It is generally found that for flash tubes having a gap distance $t_g$ of from about 1 to 300 cm, and ionization potentials $V_s$ on the order of from 50 to 5000 volts, it is found that using a pulse frequency which is suitable for the production of visible light on the order of 60 to 20,000 hz, $T_w$ will generally be in the range of from about 0.1 to 10 percent of $T_r$. Furthermore, it is found that these typical tubes normally require a $V_b$ on the order of 1 to 1000 when $V_b$ is chosen as an essentially constant DC potential. It is also understood that $V_b$ may fluctuate somewhat and in certain instances may constitute an alternating potential. In this instance, $V_b$ is calculated to provide the ion removal energy which is equivalent to $V_b$ indicated above as a constant DC source.

The operation of the power supply shown in FIG. 3 involves adjusting the pulse generator 24 to provide the desired frequency necessary to produce acceptable visible light from flash tube 50. As indicated above, the frequency will normally be in the range of from about 60 to 20,000 hz. In order to provide the desired bias potential, the DC power supply 35 and/or the DC power supply 56 may be appropriately adjusted.

To provide an efficient high frequency narrow pulse power, it is highly desirable to utilize a gas filled switch tube such as 27 so that square wave pulses shown as curve E-1 in FIG. 2 are initially produced. However, to minimize the resistance losses which inherently are produced by the abrupt charging of a capacitance load such as the flash tube 50, a suitable inductance 53 is selected so as to produce the rounded curve E-2. Normally the inductance 53 will have a value on the order of $10^{-7}$ to 1 henrys.

The components set forth in the circuit of FIG. 3 are generally conventional in that the pulse generator 24 is selected to produce trigger pulses on the order of 1 to 2000 volts DC at frequencies ranging from 60 to 20,000 hz. Power supply 25, which is connected to the pulse generator 24, is capable of producing 0 to ± 1000 volts, whereas the DC power supply 45 produces 0 to 10,000 volts at an output of 1000 watts. The DC power supply 56 likewise is capable of producing a variable power supply shown in detail within the confines of dashed line 35. The vacuum switch tube 27 is shown in the circuit of FIG. 3 to be a tetrode. However, it is contemplated that pentodes and triodes may also be used, the adaption of which to the present circuit is readily apparent to one skilled in the art.

Having described the basic aspects of the present invention, the following example is given to illustrate the specific embodiments thereof.

EXAMPLE

A gas filled electrical discharge tube was selected which has an electrode spacing, $t_g$, of 100 cm., a diameter of about 3 cm, and an internal atmosphere of 25 mmHg pressure of xenon. The ionization potential of the tube, $V_s$, was found to be 6000 volts. The tube was connected to a power supply source similar to that shown in FIG. 3. The pulse generator 24 was adjusted to operate at 60 hz. The output of the circuit was adjusted to produce a maximum E-1 voltage as shown in FIG. 2 of 10,000 volts, a corresponding maximum E-2 voltage of 4,000 volts, and a maximum $V_g$ voltage of 6,000 volts, which corresponded to the ionization potential of the tube. The circuit operated to vary the pulse width, $T_w$, in a range of from about 0.1 to 10 microseconds. $V_b$ was adjusted by use of appropriate power supply at a steady positive 800 volts DC.

It was found that a pulse width, $T_w$, of less than about 5 microseconds the tube produced a diffuse "cool" light with little evidence of heating of the tube external surface. When the pulse width was increased to above about 10 microseconds an intense "hot" light was produced with considerable flashing and evolution of heat as evidenced by heating of the tube surface. It was concluded that the discharge tube produced more light and less heat when the preferred narrow pulse power was utilized. Accordingly, the present invention provides a means by which the electrical efficiency of light producing gas filled discharge tubes may be increased.

I claim:

1. In a method for producing light from a gas filled tube wherein electrical energy is applied to the electrodes of said tube at a potential in excess of the ionization potential, the improvement which comprises:

a. dissipating pulsed electrical energy between the electrodes of said tube, wherein the pulses have a potential in excess of the ionization potential, a duration of less than the gas ion transit time between the electrodes, and greater than the electron transit time; and b. maintaining a low voltage bias potential across the electrodes less than said ionization potential to remove gas ions from between the electrodes.

2. The method of claim 1 wherein said tube is filled with a gas selected from the group consisting of neon, argon, krypton, xenon, mercury and sodium.

3. The method of claim 1 wherein the ionization potential ranges from 50 to 100,000 volts.

4. The method of claim 1 wherein the narrow pulses have a duration of from about 0.1 to 10 percent of the singly charged gas ion transit time between said electrodes.

5. The method of claim 1 wherein the said power has a pulse frequency of 60 to 20,000 Hz.

6. The method of claim 5 wherein the pulse duration is from about 0.1 to 10 percent of the pulse repetition period.

7. The method of claim 1 wherein said bias potential is a positive, negative and/or alternating potential having a magnitude from about 0.1 to 10 percent of said ionization potential.

8. The method of claim 6 wherein said gas has a pressure of from about 0.1 to $10^{-7}$ atmospheres.

* * * * *